US010639559B1

(12) United States Patent
Sutton

(10) Patent No.: US 10,639,559 B1
(45) Date of Patent: May 5, 2020

(54) BOW WITH SEPARABLE STORAGE CONTAINERS

(71) Applicant: Jay At Play International Hong Kong Limited, Kowloon (HK)

(72) Inventor: Joseph A. Sutton, Delray Beach, FL (US)

(73) Assignee: Jay at Play International Hong Kong Limited, Kowloon (HK)

( * ) Notice: Subject to any disclaimer, the term of this patent is extended or adjusted under 35 U.S.C. 154(b) by 0 days.

(21) Appl. No.: 16/506,635

(22) Filed: Jul. 9, 2019

(51) Int. Cl.

| | |
|---|---|
| ***A63H 3/02*** | (2006.01) |
| ***A45D 8/12*** | (2006.01) |
| ***A63H 3/00*** | (2006.01) |
| ***A63H 3/36*** | (2006.01) |
| ***A45D 8/14*** | (2006.01) |
| *A45D 8/00* | (2006.01) |

(52) U.S. Cl.
CPC ..... *A63H 3/005* (2013.01); *A45D 8/14* (2013.01); *A63H 3/36* (2013.01); *A45D 2008/004* (2013.01); *A63H 3/02* (2013.01)

(58) Field of Classification Search
CPC ..... A41D 25/02; A41D 25/04; A41D 20/00; A41D 25/005; A41D 25/025; A41D 25/027; A45D 2008/006; A45D 8/00; A45D 8/14; Y10T 24/44026; Y10T 24/45063; Y10T 428/24017; A42B 1/24; G09B 1/02; G09B 23/28; A63H 3/02; A63H 3/44; A63H 3/003; A63H 3/005; A63H 3/36; Y10S 2/11; Y10S 446/901; Y10S 24/53
USPC ..... 446/71, 73
See application file for complete search history.

(56) References Cited

U.S. PATENT DOCUMENTS

| | | | | |
|---|---|---|---|---|
| 1,531,230 A * | 3/1925 | Bernstein | A41D 25/025 2/154 |
| 2,421,972 A * | 6/1947 | Taborski | A41D 25/02 2/151 |
| 2,466,131 A * | 4/1949 | Taborski | A41D 25/02 2/151 |
| 4,204,361 A * | 5/1980 | Chaput | A63H 3/52 446/74 |

(Continued)

FOREIGN PATENT DOCUMENTS

CN 109156962 A 1/2019

OTHER PUBLICATIONS

Commonwealth Toy & Novelty Co., "Bowzeez Surprise!" <http://commonwealthtoy.com/bowzeez> 2019, 2 pages.

*Primary Examiner* — Nini F Legesse
(74) *Attorney, Agent, or Firm* — Michael Best & Friedrich LLP

(57) ABSTRACT

A bow includes a central member having a first end, a second end spaced from the first end, an inner surface, and an outer surface. A first pouch has a first end with an opening configured to permit access into a cavity of the first pouch, and a second end spaced from the first end. A second pouch has a first end with an opening configured to permit access into a cavity of the second pouch, and a second end spaced from the first end. The first end of the central member is configured to removably receive the first end of the first pouch and the second end of the central member is configured to removably receive the first end of the second pouch, such that when joined together, the central member, the first pouch, and the second pouch are in the shape of a bow.

23 Claims, 4 Drawing Sheets

(56) References Cited

U.S. PATENT DOCUMENTS

| | | | | | |
|---|---|---|---|---|---|
| 4,993,988 | A * | 2/1991 | Chamberlain | A63H 3/44 | 446/319 |
| D356,887 | S * | 4/1995 | Revson | D28/41 | |
| 5,413,126 | A * | 5/1995 | Revson | A45C 1/04 | 132/273 |
| D373,851 | S * | 9/1996 | Martinez | D28/41 | |
| 5,683,769 | A | 11/1997 | Cheng | | |
| 6,105,837 | A | 8/2000 | Teed | | |
| 6,263,885 | B1 * | 7/2001 | Levy | A44C 5/0053 | 132/273 |
| 7,293,566 | B2 | 11/2007 | Thall | | |
| 8,820,117 | B2 | 9/2014 | Fox et al. | | |
| 9,138,023 | B2 | 9/2015 | Karam | | |
| 9,949,551 | B1 | 4/2018 | Boles et al. | | |
| 2003/0096066 | A1 | 5/2003 | Clark | | |
| 2005/0199659 | A1 * | 9/2005 | Teed | A41D 20/00 | 224/181 |
| 2007/0054593 | A1 * | 3/2007 | Santos | A63H 3/003 | 446/369 |
| 2014/0227933 | A1 * | 8/2014 | Bagla | A63H 3/02 | 446/73 |
| 2016/0183656 | A1 | 6/2016 | Karam | | |
| 2018/0317581 | A1 * | 11/2018 | Jacks | A41D 25/025 | |
| 2019/0014878 | A1 | 1/2019 | Stewart et al. | | |

* cited by examiner

BOW WITH SEPARABLE STORAGE CONTAINERS

BACKGROUND

The present invention relates to bows of the type used with toys, bows of the type used as hair or clothing accessories, and bows of the type used for other decorative applications.

SUMMARY

In one embodiment, the invention provides a bow with a central member having a first end, a second end spaced from the first end, an inner surface, and an outer surface. A first pouch has a first end with an opening configured to permit access into a cavity of the first pouch, and a second end spaced from the first end. A second pouch has a first end with an opening configured to permit access into a cavity of the second pouch, and a second end spaced from the first end. The first end of the central member is configured to removably receive the first end of the first pouch and the second end of the central member is configured to removably receive the first end of the second pouch, such that when joined together, the central member, the first pouch, and the second pouch are in the shape of a bow.

In another embodiment the invention provides a toy including a body, a head coupled to the body, and a bow removably coupled to the head. The bow includes a central member having a first end, a second end spaced from the first end, an inner surface, and an outer surface. A fastener is coupled to the outer surface of the central member for removably securing the central member to the head. A first pouch has a first end with an opening configured to permit access into a cavity of the first pouch, and a second end spaced from the first end. A second pouch has a first end with an opening configured to permit access into a cavity of the second pouch, and a second end spaced from the first end. The first end of the central member is configured to removably receive the first end of the first pouch and the second end of the central member is configured to removably receive the first end of the second pouch, such that when joined together, the central member, the first pouch, and the second pouch are in the shape of a bow.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
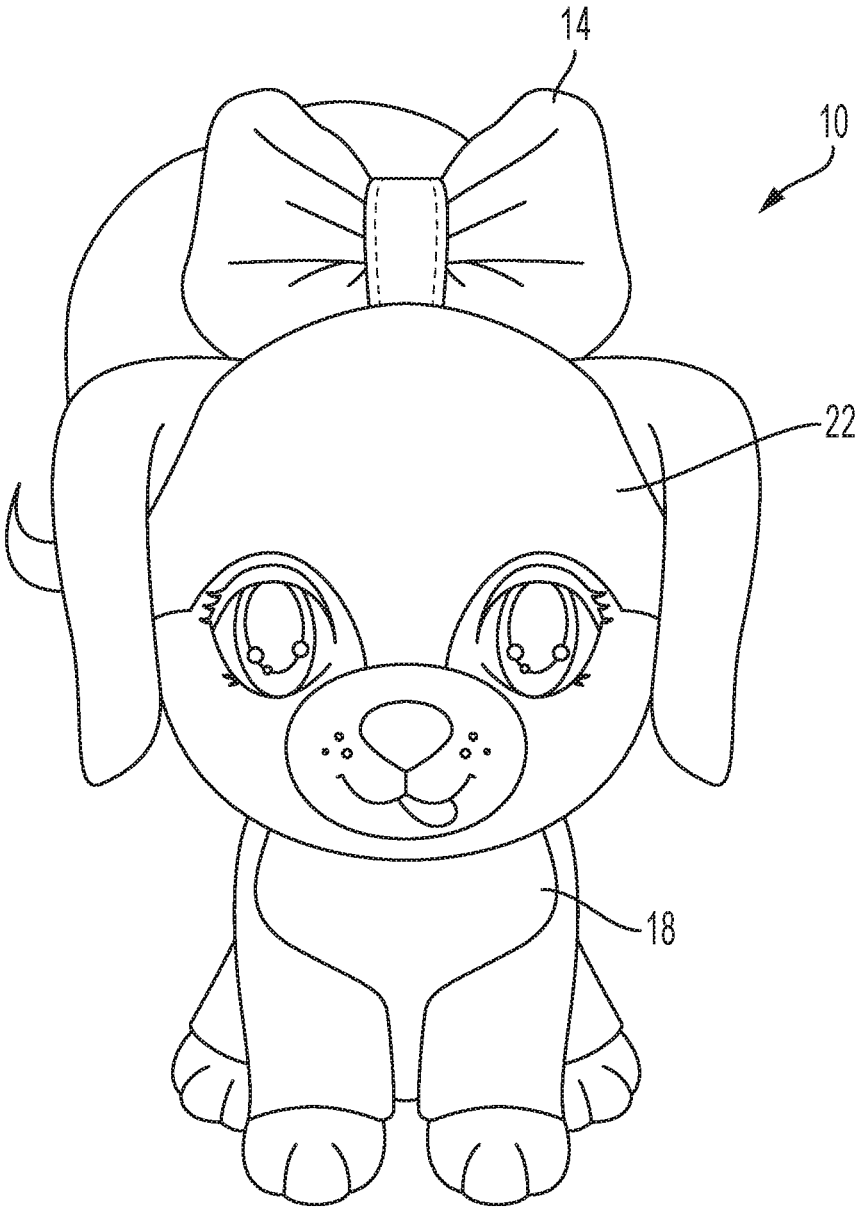
FIG. 1 is a front view of a toy including a bow of one embodiment of the invention.
Figure 2:
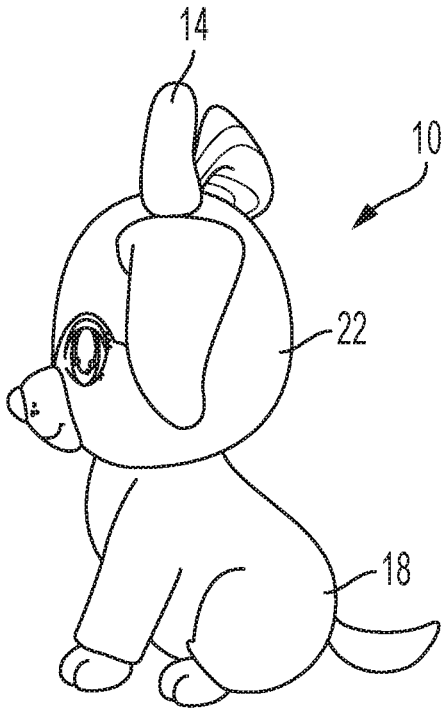
FIG. 2 is a side view of the toy of FIG. 1.
Figure 3:
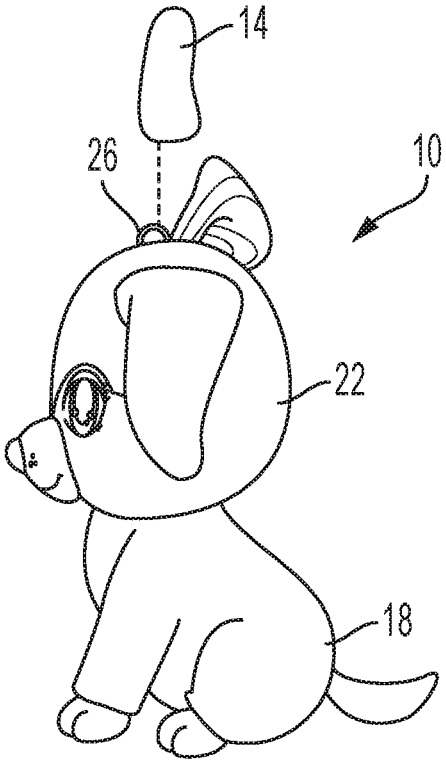
FIG. 3 is a side view of the toy of FIG. 1 showing the bow removed.

FIGS. 1-3 illustrate a toy 10 having a bow 14 according to one embodiment of the invention. The illustrated toy 10 is a dog having a body 18 and a head 22 coupled to the body 18. The illustrated toy 10 is a plush toy, but in other embodiments, could be toys made in other manners and from any suitable materials. Furthermore, the toy 10 can take the form of other animals, characters, and creatures. For example, the toy 10 could alternatively take the form of a doll representing a human baby or child.

As shown in FIG. 3, the toy 10 includes a mounting member 26, which in the illustrated embodiment, is coupled with the head 22 for removably securing the bow 14 to the head 22. In other embodiments, the bow 14 could be coupled with the body 18. In yet other toy embodiments, there may not be a defined head or body, and the bow 14 can simply be said to be removably secured to the toy 10. The illustrated mounting member 26 is a loop formed of fabric, elastic material, or any suitable material configured to be coupled to the head 22 and to be engaged by the bow 14 to permit the bow 14 to be removably secured to the head 22. In other embodiments, the mounting member 26 could take the form of a component of a hook-and-loop fastener, a mating half of a snap or button, a projection, a recess, an adhesive or any other structure capable of permitting removable attachment of the bow 14 to the head 22. In yet other embodiments, the bow 14 might be permanently fastened to the toy 10 such that the mounting member 26 might affect a permanent stitching, welding, gluing, or other fastening of the bow 14 to the toy 10.

Figure 4:
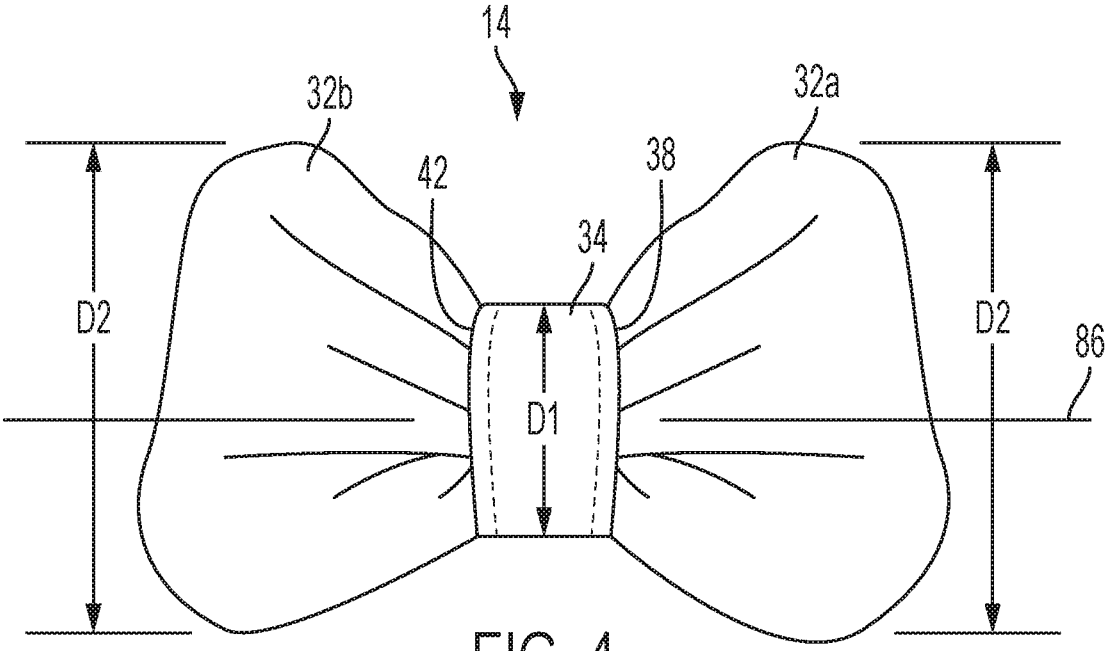
FIG. 4 is a front view of the bow removed from the toy.

The bow 14 is configured, in its assembled form, to have the shape of a decorative bow as best illustrated in FIGS. 1 and 4. The bow 14 is further configured, in its disassembled form, to include two separate storage containers or pouches 32*a*, 32*b* capable of holding one or more items 30. The items 30 are accessible to a user when the bow 14 is disassembled, and are contained within the bow 14 and inaccessible to a user when the bow 14 is assembled.

Figure 5:
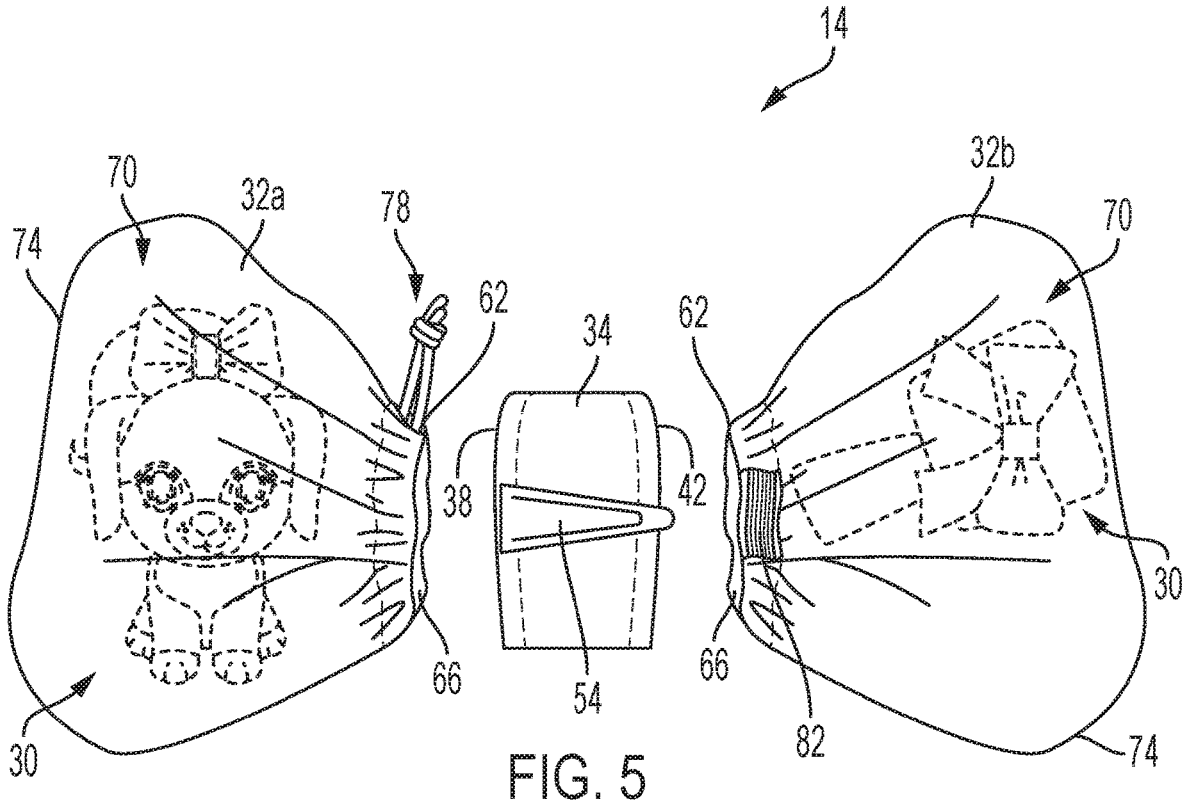
FIG. 5 is a rear exploded view of the bow of FIG. 4.
Figure 6:
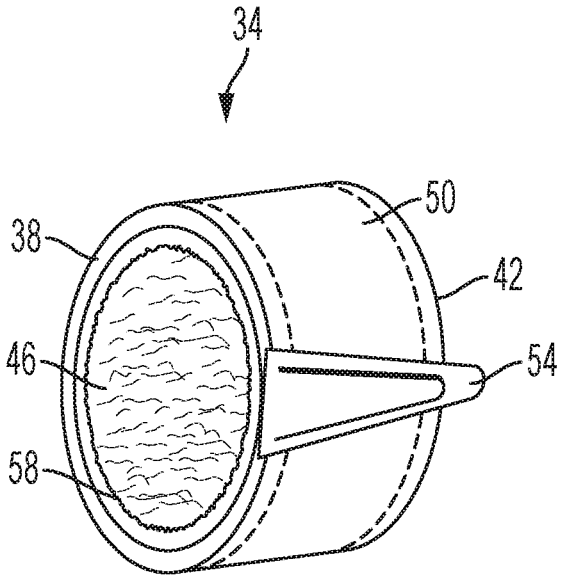
FIG. 6 is a rear perspective view of the central member of the bow of FIG. 4.

Referring now to FIGS. 5 and 6, the bow 14 includes a central member 34 having a first end 38, a second end 42 spaced from the first end 38, an inner surface 46, and an outer surface 50. In the illustrated embodiment, the central member 34 includes a loop or ring of material (e.g., fabric, rubber, ribbon, or any other suitable material) that defines a closed annular or circular shape. Any suitable colors, patterns, and textures can be used for the central member 34 depending on the desired appearance of the bow 14.

An optional fastener 54 (see FIG. 5) is coupled to the outer surface 50 of the central member 34 and is configured to secure the central member 34 to the toy 10, or alternatively, to other items, including, but not limited to a person's hair, clothing, or other accessories. In the illustrated embodiment, the fastener 54 is a clip or a barrette that removably secures the central member 34 to the mounting member 26 of the toy 10 as shown in FIGS. 2 and 3, but that can also be used to secure the central member 34 to, for example, the hair of a person or doll. The fastener 54 can take any other suitable forms as well, and for example, could take the form of a component of a hook-and-loop fastener, a mating half of a snap or button, a projection, a recess, a loop of fabric, an adhesive, or any other structure capable of permitting removable attachment of the central member 34 to the mating mounting member 26, or more generally, to other items to which the bow 14 might be attached. The fastener 54 can be secured to the central member 34 in any suitable manner, including but not limited to stitching, adhesives, snaps, buttons, and the like.

Another optional fastener 58 (see FIG. 6) can be provided on the inner surface 46 of the central member 34. As will be described in greater detail below, the fastener 58 can be provided to help secure the pouches 32*a*, 32*b* of the bow 14 to the central member 34. In the illustrated embodiment, the fastener 58 includes a component of a hook-and-loop fastener (e.g., the hook half or the loop half) on the inner surface 46 of the central member 34. The component of the hook-and-loop fastener can cover all or only a portion of the inner surface 46. The component of the hook-and-loop fastener is configured to removably fasten to material from which the first and second pouches 32*a*, 32*b* are made to removably secure the pouches 32 in the central member 34. In other embodiments, the pouches 32 can separately include the other half of the hook-and-loop fastener component secured thereto for mating with the fastener 58 in the central member 34. In yet other embodiments, the fastener 58 can take other forms, such as a resilient bead or line of material configured to grip the pouches 32 and hold them securely in the central member 34. Snaps, buttons, or other suitable fasteners could also be used.

As best seen in FIG. 5, the bow 14 includes two containers or pouches 32*a* and 32*b* that can be identical to one another, or as illustrated in FIG. 5, can be somewhat different from one another. Differences between the pouches 32*a*, 32*b* will be explained in detail, however, similar features of the pouches will be described as being present on both pouches 32*a*, 32*b*, and will have like reference numerals. Each pouch 32*a*, 32*b* includes a first end 62 with an opening 66 configured to permit access into a cavity 70 of the respective pouch, and a second end 74 spaced from the first end 62. The second ends 74 are closed so as not to permit access into the cavity 70 at the second end 74. Each pouch 32*a*, 32*b* can be made of fabric or any other suitable material to provide the desired appearance for the bow 14. The same or different fabrics can be used for the two pouches 32*a*, 32*b*, and/or the central member 34, thus providing complete flexibility for the appearance of the bow 14. In the illustrated embodiment, the fabric used for the pouches 32*a*, 32*b* is configured to cooperate with the fastener 58 on the inner surface 46 of the central member 34 such that engaging the pouches 32*a*, 32*b* with the fastener 58 removably secures the pouches 32*a*, 32*b* to the central member 34. Like the central member 34, any suitable colors, patterns, and textures can be used for the pouches 32*a*, 32*b* depending on the desired appearance of the bow 14.

The openings 66 on each pouch 32*a*, 32*b* can include closures configured to close or at least partially close the respective opening 66 in order to retain the item(s) 30 in the cavity 70. As illustrated in FIG. 5, the first pouch 32*a* includes a drawstring 78 operable in a known manner to selectively close or permit expansion of the opening 66. The second pouch 32*b* includes an elastic member or band 82 provided in or along the opening 66 to resiliently bias the opening 66 closed in a known manner. To open the opening 66, the user merely stretches the elastic band 82 manually. Both the illustrated drawstring 78 and the illustrated elastic band 82 can be sewn into the first end 62 adjacent the opening 66 as shown. In some embodiments, both pouches 32*a* and 32*b* can include drawstring 78 closures, while in other embodiments, both pouches 32*a* and 32*b* can include elastic band 82 closures. In yet other embodiments, other closure devices, such as hook-and-loop fasteners, snaps, buttons, or the like can be used to selectively open and close the pouches 32*a*, 32*b*.

The first end 38 of the central member 34 is configured to removably receive the first end 62 of the first pouch 32*a* and the second end 42 of the central member 34 is configured to removably receive the first end 62 of the second pouch 32*b*, such that when joined together, the central member 34, the first pouch 32*a*, and the second pouch 32*b* are in the shape of a bow (see FIGS. 1 and 4). The pouches 32*a*, 32*b* are removably secured inside the respective ends 38, 42 of the central member 34 due to the engagement between the material or fabric of the pouches 32*a*, 32*b* and the fastener 58 on the inner surface 46 of the central member 34. A user may need to squeeze the central member 34 when the first ends 62 of the pouches 32*a*, 32*b* are installed therein so as to facilitate the gripping securement between the fastener 58 and the pouch material.

With reference to FIG. 4, the bow 14 includes a longitudinal axis 86 that extends through the central member 34 in a direction from the first end 38 of the central member 34 toward the second end 42 of the central member 38. The central member 34 has a first dimension D1 (e.g., a diameter) in a direction perpendicular to the longitudinal axis 86, while the second end 74 of the first pouch 32*a* and the second end 74 of the second pouch 32*b* each have a second dimension D2 in a direction perpendicular to the longitudinal axis 86 that is larger than the first dimension D1. Having the first dimension D1 smaller than the second dimension D2 helps to give the assembled unit the appearance of a bow 14. Furthermore, the first pouch 32*a* tapers from a larger dimension at the second end 74 to a smaller dimension at the first end 62, and likewise, the second pouch 32*b* tapers from a larger dimension at the second end 74 to a smaller dimension at the first end 62. This taper also helps to give the assembled unit the appearance of a bow 14. The first ends 62 of the pouches 32*a*, 32*b*, when closed, can be squeezed to a size that permits insertion of the first ends 62 into the respective first and second ends 38, 42 of the central member 34. As seen in FIGS. 1 and 4, this squeezing or bunching of the first ends 62 of the pouches 32*a*, 32*b* can provide a pleated or gathered appearance common on bows 14.

Operation of the toy 10 and bow 14 will now be described. In one example, the toy 10 may be sold with the bow 14 removably fastened thereto. The toy 10 may be advertised as having a bow 14 containing "surprises" inside. A user can either remove the bow 14 from the toy 10 by removing the fastener 54 from the mounting member 26 before disassembling the bow 14, or can disassemble the bow 14 while it is still secured to the toy 10. In either case, the user can grasp and pull the second ends 74 of the pouches 32*a*, 32*b* in opposite directions along the longitudinal axis 86 until the fastener 58 releases the first ends 62 of the pouches 32*a*, 32*b* from inside the central member 34. With the pouches 32*a*, 32*b* separated from the central member 34, the openings 66 are exposed, and the user can open the openings 66 via relaxing the drawings 78 or expanding the elastic band 82 to gain access into the cavity 70. As shown in FIG. 5, the first pouch 32*a* could include an item 30 such as a figurine that takes the same or similar form as the toy 10 itself. The second pouch 32*b* could include an item 30 such as a toy brush that can be used to brush the fur of the toy 10 or the figurine item 30. Of course, the items 30 can be any item selected to be sold with the toy 10 (e.g., candy, stickers, accessories, etc.). Additionally, the user can place his or her own items 30 into the pouches 32*a*, 32*b* when playing with or using the bow 14.

When the user desires to re-assemble the bow 14, he or she can choose whether or not to re-insert the items 30 into the pouches 32*a*, 32*b*. The user can then close the openings 66 by pulling the drawstrings 78, allowing the elastic members 82 to automatically retract, or otherwise operating the alternative closures to close the openings 66. Next, the first end 62 of the first pouch 32*a* is squeezed and inserted into the first end 38 of the central member 34 and the first end 62 of the second pouch 32*b* is squeezed and inserted into the second end 42 of the central member 34. A user may then squeeze or apply pressure to the central member 34 to ensure that the fastener 58 engages with the inserted first ends 62 of the pouches 32*a*, 32*b* to secure them in the assembled condition.

If the user wishes to use the bow 14 without the toy 10, he or she can disconnect the bow 14 from the mounting member 26 by unclipping or otherwise un-securing the fastener 54 from the mounting member 26. The bow 14 is then free to be used by itself, and can be connected to other items. For example, the user may wish to wear the bow 14 in her hair, and can do so when the fastener 54 is a barrette or clip that can secure the bow 14 directly in the user's hair. Alternatively, the user can secure the bow 14, using the fastener 54, to a hair band, head band, ponytail holder, or other hair accessory to indirectly secure the bow 14 in the user's hair. In yet other applications, the user can secure the bow 14 to clothing, accessories, or any other items or articles as desired. For example, one or more bows 14 could be secured to a wreath or Christmas tree for both decoration and as a container or vessel for housing gifts (i.e., the items 30 contained in the pouches 32*a*, 32*b*). The bow 14 could also be used in wrapping gifts or to accompany gift bags.

The illustrated bow 14 provides a multi-purpose article having both decorative uses and storage capabilities. By including two separate, closable pouches 32*a*, 32*b*, a user has greater flexibility in the variety and separation of items 30 that can be stored. Assembly and disassembly is simple. Furthermore, the bow 14 truly looks like and takes the form of a decorative bow, such that casual observers may not even recognize that items 30 are stored therein. In that sense, the bow 14 can act as a hidden or secret storage vessel.

Various features of the invention are set forth in the following claims.

What is claimed is:

1. A bow comprising:
- a central member having
  - a first end;
  - a second end spaced from the first end;
  - an inner surface; and
  - an outer surface;
- a first pouch having
  - a first end having a perimeter that defines an opening configured to permit access into a cavity of the first pouch; and
  - a second end spaced from the first end; and
- a second pouch having
  - a first end having a perimeter that defines an opening configured to permit access into a cavity of the second pouch; and
  - a second end spaced from the first end;
- wherein the first end of the central member is configured to removably receive the perimeter of the first end of the first pouch inside of the first end of the central member, and the second end of the central member is configured to removably receive the perimeter of the first end of the second pouch inside of the second end of the central member, such that when joined together, the central member, the first pouch, and the second pouch are in the shape of a bow.

2. The bow of claim 1, further comprising a fastener coupled to the outer surface of the central member and configured to secure the central member to an item.

3. The bow of claim 2, wherein the fastener is a clip or a barrette that removably secures the central member to an item.

4. The bow of claim 1, wherein the opening of at least one of the first pouch or the second pouch includes a drawstring configured to selectively close the opening.

5. The bow of claim 1, wherein the opening of at least one of the first pouch or the second pouch includes an elastic member urging the opening toward a closed condition.

6. The bow of claim 1, wherein each of the first and second pouches contains an item in the respective cavities.

7. The bow of claim 1, wherein the bow includes a longitudinal axis that extends through the central member in a direction from the first end of the central member toward the second end of the central member, wherein the central member has a first dimension in a direction perpendicular to the longitudinal axis, wherein the second end of the first pouch and the second end of the second pouch have a second dimension in a direction perpendicular to the longitudinal axis, and wherein the first dimension is smaller than the second dimension.

8. The bow of claim 1, wherein the first pouch tapers from a larger dimension at the second end to a smaller dimension at the first end, and wherein the second pouch tapers from a larger dimension at the second end to a smaller dimension at the first end.

9. The bow of claim 1, wherein the central member is a ring.

10. The bow of claim 1, further comprising a fastener coupled to the inner surface of the central member, the fastener configured to removably secure the first and second pouches to the central member.

11. The bow of claim 10, wherein the fastener is a component of a hook and loop fastener on the inner surface of the central member, the component of the hook and loop fastener configured to removably fasten to material from which the first and second pouches are made to removably secure the respective first ends of the first and second pouches in the central member.

12. A toy comprising:
- a body;
- a head coupled to the body; and
- a bow removably coupled to the head, the bow comprising:
  - a central member having
    - a first end;
    - a second end spaced from the first end;
    - an inner surface; and
    - an outer surface;
  - a fastener coupled to the outer surface of the central member for removably securing the central member to the head;
  - a first pouch having
    - a first end having a perimeter that defines an opening configured to permit access into a cavity in the first pouch; and
    - a second end spaced from the first end; and
  - a second pouch having
    - a first end having a perimeter that defines an opening configured to permit access into a cavity in the second pouch; and
    - a second end spaced from the first end;

wherein the first end of the central member is configured to removably receive the perimeter of the first end of the first pouch inside of the first end of the central member, and the second end of the central member is configured to removably receive the perimeter of the first end of the second pouch inside of the second end of the central member, such that when joined together, the central member, the first pouch, and the second pouch are in the shape of a bow.

13. The toy of claim 12, wherein the toy includes a mounting member attached to the head and configured to engage the fastener to removably secure the central member to the head.

14. The toy of claim 12, wherein the fastener is a clip or a barrette.

15. The toy of claim 12, wherein the opening of at least one of the first pouch or the second pouch includes a drawstring configured to selectively close the opening.

16. The toy of claim 12, wherein the opening of at least one of the first pouch or the second pouch includes an elastic member urging the opening toward a closed condition.

17. The toy of claim 12, wherein each of the first and second pouches contains an item in the respective cavities.

18. The toy of claim 17, wherein at least one item in a cavity is a figurine resembling the toy.

19. The toy of claim 12, wherein the bow includes a longitudinal axis that extends through the central member in a direction from the first end of the central member toward the second end of the central member, wherein the central member has a first dimension in a direction perpendicular to the longitudinal axis, wherein the second end of the first pouch and the second end of the second pouch have a second dimension in a direction perpendicular to the longitudinal axis, and wherein the first dimension is smaller than the second dimension.

20. The toy of claim 12, wherein the first pouch tapers from a larger dimension at the second end to a smaller dimension at the first end, and wherein the second pouch tapers from a larger dimension at the second end to a smaller dimension at the first end.

21. The toy of claim 12, wherein the central member is a ring.

22. The toy of claim 12, further comprising a fastener coupled to the inner surface of the central member, the fastener configured to removably secure the first and second pouches to the central member.

23. The toy of claim 22, wherein the fastener is a component of a hook and loop fastener on the inner surface of the central member, the component of the hook and loop fastener configured to removably fasten to material from which the first and second pouches are made to removably secure the respective first ends of the first and second pouches in the central member.

* * * * *